US009524820B2

(12) United States Patent
Jacobson et al.

(10) Patent No.: US 9,524,820 B2
(45) Date of Patent: Dec. 20, 2016

(54) APPARATUS AND METHOD FOR THERMAL MANAGEMENT OF MAGNETIC DEVICES

(71) Applicant: Raytheon Company, Waltham, MA (US)

(72) Inventors: Boris S. Jacobson, Westford, MA (US); Stephen R. Elkins, Franklin, MA (US)

(73) Assignee: RAYTHEON COMPANY, Waltham, MA (US)

( * ) Notice: Subject to any disclaimer, the term of this patent is extended or adjusted under 35 U.S.C. 154(b) by 805 days.

(21) Appl. No.: 13/675,092

(22) Filed: Nov. 13, 2012

(65) Prior Publication Data

US 2014/0132380 A1 May 15, 2014

(51) Int. Cl.

| | |
|---|---|
| ***H01F 27/08*** | (2006.01) |
| ***H01F 27/10*** | (2006.01) |
| ***H01F 27/02*** | (2006.01) |
| ***H01F 27/24*** | (2006.01) |
| ***H01F 27/28*** | (2006.01) |

(52) U.S. Cl.

CPC ..... *H01F 27/025* (2013.01); *H01F 27/08* (2013.01); *H01F 27/24* (2013.01); *H01F 27/2876* (2013.01); *Y10T 29/49071* (2015.01)

(58) Field of Classification Search

CPC ..... H01F 27/08
USPC ..... 336/60
See application file for complete search history.

(56) References Cited

U.S. PATENT DOCUMENTS

| | | | | |
|---|---|---|---|---|
| 3,043,000 A | | 7/1962 | Hatfield | |
| 4,623,771 A | | 11/1986 | Sakino | |
| 5,508,672 A | | 4/1996 | Sokai | |
| 5,545,966 A | | 8/1996 | Ramos et al. | |
| 5,660,749 A | * | 8/1997 | Taguchi | H01F 27/085 219/130.1 |
| 5,808,535 A | | 9/1998 | Delucia | |
| 6,384,703 B1 | | 5/2002 | Ramos et al. | |

(Continued)

FOREIGN PATENT DOCUMENTS

| | | |
|---|---|---|
| EP | 0124809 A1 | 11/1984 |
| GB | 167916 A | 8/1921 |

OTHER PUBLICATIONS

J. Biela, et al., "Cooling Concepts for High Power Density Magnetic Devices", IEEJ Trans. IA, vol. 128, No. 4, 2008, p. 1-8.

(Continued)

*Primary Examiner* — Elvin G Enad
*Assistant Examiner* — Ronald Hinson

(57) ABSTRACT

An apparatus includes a coil assembly, a core, and at least one cooling channel. The coil assembly includes at least one winding configured to receive a varying electrical current. The core includes multiple segments, and the at least one winding is wound around portions of the segments and is configured to generate a magnetic flux. The at least one cooling channel is configured to transport coolant through the coil assembly or core in order to cool the coil assembly or core. Portions of the segments of the core can be separated from one another to form multiple cooling channels through the core, and the multiple cooling channels can be configured to transport coolant through the core. The coil assembly may include at least one insulative spacer having multiple cooling channels, and the multiple cooling channels may be configured to transport coolant through the coil assembly.

15 Claims, 11 Drawing Sheets

(56) References Cited

U.S. PATENT DOCUMENTS

| | | | |
|---|---|---|---|
| 6,885,268 | B2 | 4/2005 | Choi |
| 7,002,443 | B2 | 2/2006 | Ness et al. |
| 7,142,085 | B2 | 11/2006 | Phadke |
| 7,489,226 | B1 | 2/2009 | Chignola et al. |
| 8,009,004 | B2 | 8/2011 | Ahangar et al. |
| 2003/0231094 | A1 | 12/2003 | Funk |
| 2012/0075047 | A1 | 3/2012 | Luckey et al. |

OTHER PUBLICATIONS

Notification of Transmittal of The International Search Report and The Written Opinion of the International Searching Authority, or the Declaration dated Mar. 21, 2014 in connection with International Patent Application No. PCT/US2013/063791.

* cited by examiner

APPARATUS AND METHOD FOR THERMAL MANAGEMENT OF MAGNETIC DEVICES

GOVERNMENT LICENSE RIGHTS

This invention was made with government support under Contract No. N00014-09-D-0726 awarded by the U.S. Department of Defense. The government may have certain rights in the invention.

TECHNICAL FIELD

This disclosure is generally directed to magnetic devices, such as transformers and inductors. More specifically, this disclosure relates to an apparatus and method for thermal management of magnetic devices.

BACKGROUND

Various electronic devices routinely include large inductors, transformers, or other magnetic devices formed using one or more coils wrapped around a magnetic core. Certain types of magnetic devices can operate in higher frequency ranges, such as from tens of kilohertz to many megahertz or even higher. These types of magnetic devices are often cooled using forced liquid or forced air cooling. However, these types of higher-frequency magnetic devices often have magnetic cores formed from tape-wound or solid materials, such as ferrite or powdered substances. Cores such as this are typically difficult to cool even at lower power levels, such as in the range of hundreds of watts to many kilowatts, because of their low thermal conductivity. Moreover, core-to-winding insulation and inter-winding insulation can further hinder cooling of these devices.

SUMMARY

This disclosure provides an apparatus and method for thermal management of magnetic devices.

In a first embodiment, an apparatus includes a coil assembly having at least one winding configured to receive a varying electrical current. The apparatus also includes a core having multiple segments, where the at least one winding is wound around portions of the segments and is configured to generate a magnetic flux. The apparatus further includes at least one cooling channel configured to transport coolant through the coil assembly or core in order to cool the coil assembly or core.

In a second embodiment, a system includes a housing having at least one inlet configured to receive coolant and at least one outlet configured to provide the coolant. The system also includes an electronic device to be cooled within the housing, where the electronic device includes a magnetic device. The magnetic device includes a coil assembly having at least one winding configured to receive a varying electrical current. The magnetic device also includes a core having multiple segments, where the at least one winding is wound around portions of the segments and is configured to generate a magnetic flux. The magnetic device further includes at least one cooling channel configured to transport the coolant through the coil assembly or core in order to cool the coil assembly or core.

In a third embodiment, a method includes forming a coil assembly having at least one winding configured to receive a varying electrical current. The method also includes forming a core having multiple segments, where the at least one winding is wound around portions of the segments and is configured to generate a magnetic flux. The coil assembly or core includes at least one cooling channel configured to transport coolant through the coil assembly or core in order to cool the coil assembly or core.

Other technical features may be readily apparent to one skilled in the art from the following figures, descriptions, and claims.

BRIEF DESCRIPTION OF THE DRAWINGS

For a more complete understanding of this disclosure and its features, reference is now made to the following description, taken in conjunction with the accompanying drawings, in which.

DETAILED DESCRIPTION

FIGS. 1 through 12, described below, and the various embodiments used to describe the principles of the present invention in this patent document are by way of illustration only and should not be construed in any way to limit the scope of the invention. Those skilled in the art will understand that the principles of the present invention may be implemented in any type of suitably arranged device or system.

As noted above, certain types of higher-frequency magnetic devices are often cooled using forced liquid or forced air cooling. However, because of their cores' low thermal conductivity and their use of core-to-winding and inter-winding insulation, these types of devices are often difficult to cool adequately. Among other things, this can lead to the creation of significant temperature gradients from the center of a core to an outer surface of the core, creating a hot spot in the core. Other approaches, such as planar or embedded magnetics, typically cannot effectively cool both the windings and the core of a device or cannot handle the voltage, current, or loss requirements of higher-frequency or higher-power applications. This document discloses various magnetic devices having segmented cores containing cooling channels through which coolant can flow. Moreover, this document discloses various magnetic devices having cooling channels for cooling coil assemblies, including those with core-to-winding insulation or inter-winding insulation.

Figure 1:
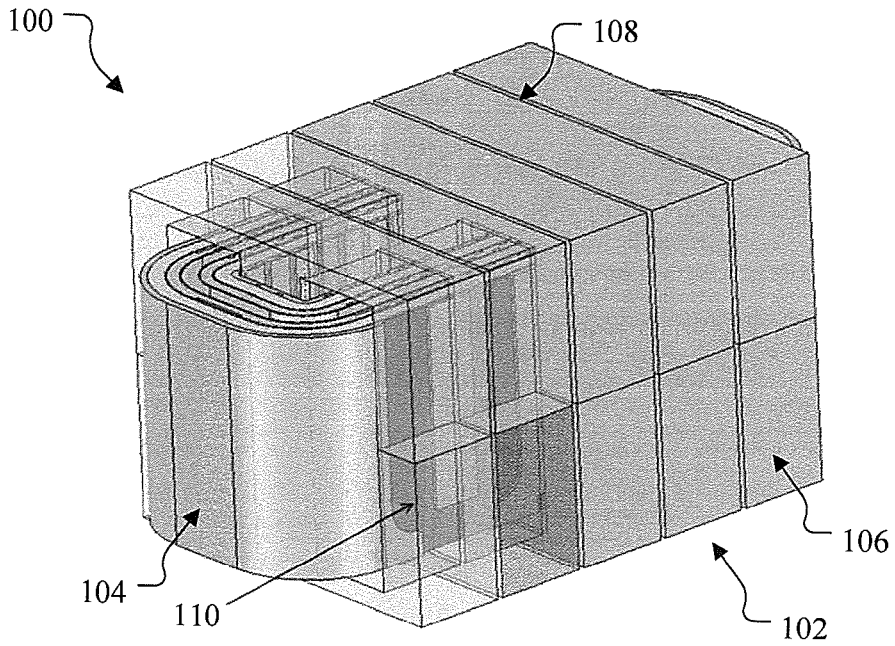
FIG. 1 illustrates a first example magnetic device having cooling channels for thermal management in accordance with this disclosure.

FIG. 1 illustrates a first example magnetic device 100 having cooling channels for thermal management in accordance with this disclosure. As shown in FIG. 1, the magnetic device 100 represents a transformer having a core 102 and a coil assembly 104. The coil assembly 104 in a transformer generally includes two or more coils or electrical windings (including at least one primary winding and at least one secondary winding), along with associated components such as insulation. Varying current in the primary winding(s) of the coil assembly 104 creates varying magnetic flux in the core 102, which then creates varying current in the secondary winding(s) of the coil assembly 104.

The core 102 includes any suitable structure for facilitating the creation of varying current in at least one winding based on varying current in at least one other winding. The core 102 could be formed from any suitable material(s), such as a ferromagnetic or powdered material. The core 102 could also be fabricated in any suitable form, such as by using tape-wound or solid materials. The core 102 could further have any suitable size and shape.

The coil assembly 104 in a transformer includes any suitable structure containing multiple windings configured to carry electrical signals. The coil assembly 104 could, for example, contain multiple windings along with insulative structures electrically separating the windings. Each winding could be formed from any suitable conductive material (s) and have any number of turns. Each winding could also be formed in any suitable manner.

As shown in FIG. 1, the core 102 is split or divided into multiple "slices" or sections 106, which are recombined to form a complete core assembly. In this example, the core 102 includes five sections 106, two of which are shown for illustrative purposes as being partially transparent in FIG. 1. In some embodiments, the core 102 is divided into the sections 106 in a direction that is parallel to or coplanar with the direction of magnetic flux formed in the device 100, which can help to prevent the sectioning from adversely affecting the magnetic properties of the core 102.

Portions of the sections 106 are separated from one another to form cooling channels 108 through the core 102. The cooling channels 108 represent areas where a coolant, such as liquid or air, can pass through the core 102 (as well as passing over the outer surfaces of the core 102). This increases the surface area of the core 106 that comes into contact with the coolant, helping to more effectively remove heat from the core 102. Depending on the implementation, the cooling channels 108 could increase the surface area of the core 106 that comes into contact with the coolant by up to 50% or even more. Each of the cooling channels 108 could have any suitable size, shape, and dimensions. The cooling channels 108 could also be formed in any suitable manner.

As described in more detail below, the coil assembly 104 can also include one or more cooling channels 110. The cooling channels 110 allow coolant to flow over or through various portions of the coil assembly 104. This can further help to remove heat from the magnetic device 100, even when the coil assembly 104 includes various types of insulation. As noted below, different types of cooling channels can be used in a coil assembly.

In this way, heat from the magnetic device 100 can be removed from both the windings and the core more effectively. Among other things, this can help to reduce temperature gradients from the center of the core 102 to an outer surface of the core 102, thereby reducing the severity of hot spots in the core 102. This can also allow the magnetic device 100 to be used in higher-frequency or higher-power applications.

Although FIG. 1 illustrates a first example of a magnetic device 100 having cooling channels for thermal management, various changes may be made to FIG. 1. For example, the core 102 could include any suitable number of sections 106. Also, the coil assembly 104 could include any suitable number of windings, each having any suitable number of turns.

Figure 2A:
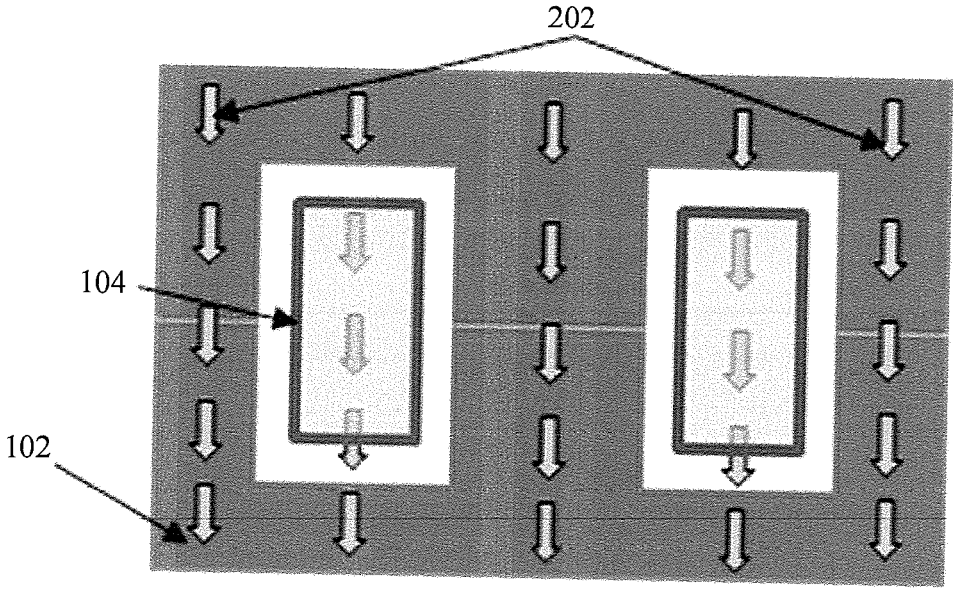
FIGS. 2A and 2B illustrate example coolant flows in the magnetic device of FIG. 1 in accordance with this disclosure.
Figure 2B:
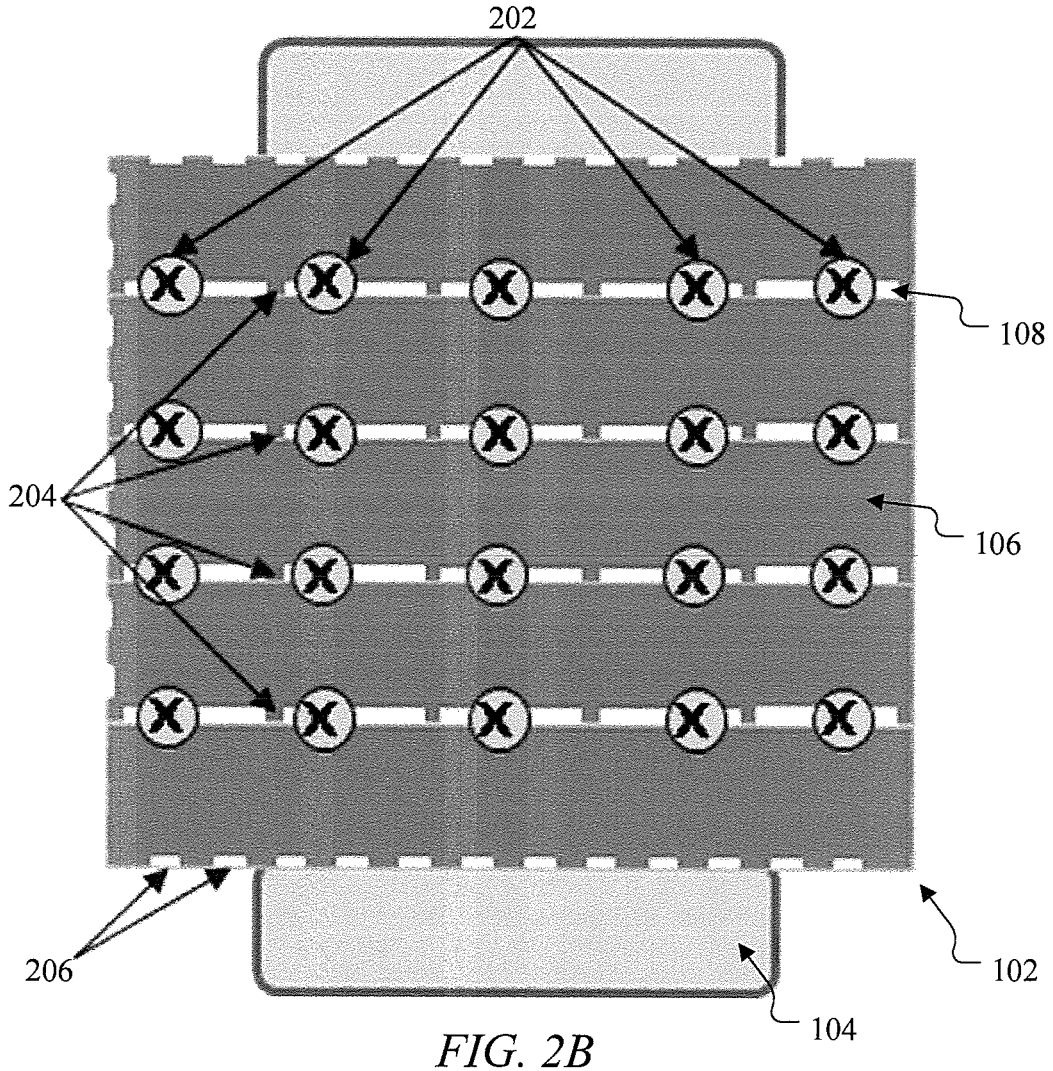

FIGS. 2A and 2B illustrate example coolant flows in the magnetic device 100 of FIG. 1 in accordance with this disclosure. In particular, FIG. 2A shows coolant flows through the magnetic device 100 when the device 100 is viewed from the side, and FIG. 2B shows coolant flows through the magnetic device 100 when the device 100 is viewed from the top or bottom.

As shown in FIGS. 2A and 2B, coolant flows 202 are created through the cooling channels 108 in the core 102. This is in addition to the coolant flowing around the outer surfaces of the device 100. Because the cooling channels 108 are present, coolant is able to contact a much larger surface area of the core 102, helping to transport a larger amount of heat away from the core 102. Here, the coolant flows 202 are generally vertical through the device 100 from top to bottom, meaning the coolant flows 202 are co-planar with or parallel to the direction of the magnetic flux formed by the device 100.

In the embodiment shown in FIG. 2B, at least some of the sections 106 of the core 102 contain spacers or other protrusions 204 that are raised on the surfaces of those sections 106. A protrusion 204 on one section 106 can contact an adjacent section 106 to help keep those sections 106 separated by some distance, thereby forming a cooling channel 108. The protrusions 204 can therefore be used to create well-defined channels 108 for the coolant flows 202, and the coolant flows 202 are controlled in part by the height(s) of the protrusions 204.

The protrusions 204 could be formed in any suitable manner, such as by machining the sections 106 of the core 102 using equipment designed to fabricate ferrite or other cores or by molding the sections 106 to include the protrusions 204. The protrusions 204 could also represent separate structures that are bonded or otherwise attached to the sections 106 of the core 102, such as rods or other structures made of ceramic or other non-magnetic material(s). By using protrusions 204 that are part of one or more sections 106, the core 102 may not require that separate spacer devices be used to form the cooling channels 108 (although the use of spacer devices is also possible). Moreover, the use of protrusions 204 that are integral parts of the sections 106 can help to restore part of the core's cross-sectional area lost due to the formation of the cooling channels 108, thereby lowering flux density and associated core losses. Further, the protrusions 204 can increase the surface area of the core 102 that is contacted by coolant, further improving heat transfer.

In some embodiments, the core 102 could also include one or more surfaces with grooves 206. The grooves 206 can be aligned with the direction of coolant flow and can further increase the core's surface area that contacts the coolant, facilitating even greater heat removal. The grooves 206 could be formed in any suitable manner, such as by machining the sections 106 of the core 102 or by molding the sections 106 to include the grooves 206. The grooves 206 could have any suitable size and shape, and the grooves 206 could be formed on any suitable surface(s) of the core 102.

Although FIGS. 2A and 2B illustrate examples of coolant flows in the magnetic device 100 of FIG. 1, various changes may be made to FIGS. 2A and 2B. For example, any suitable number of protrusions 204 could be used to separate adjacent sections 106 of the core 102, and the core 102 could include any suitable number of sections 106 and cooling channels 108.

Figure 3:
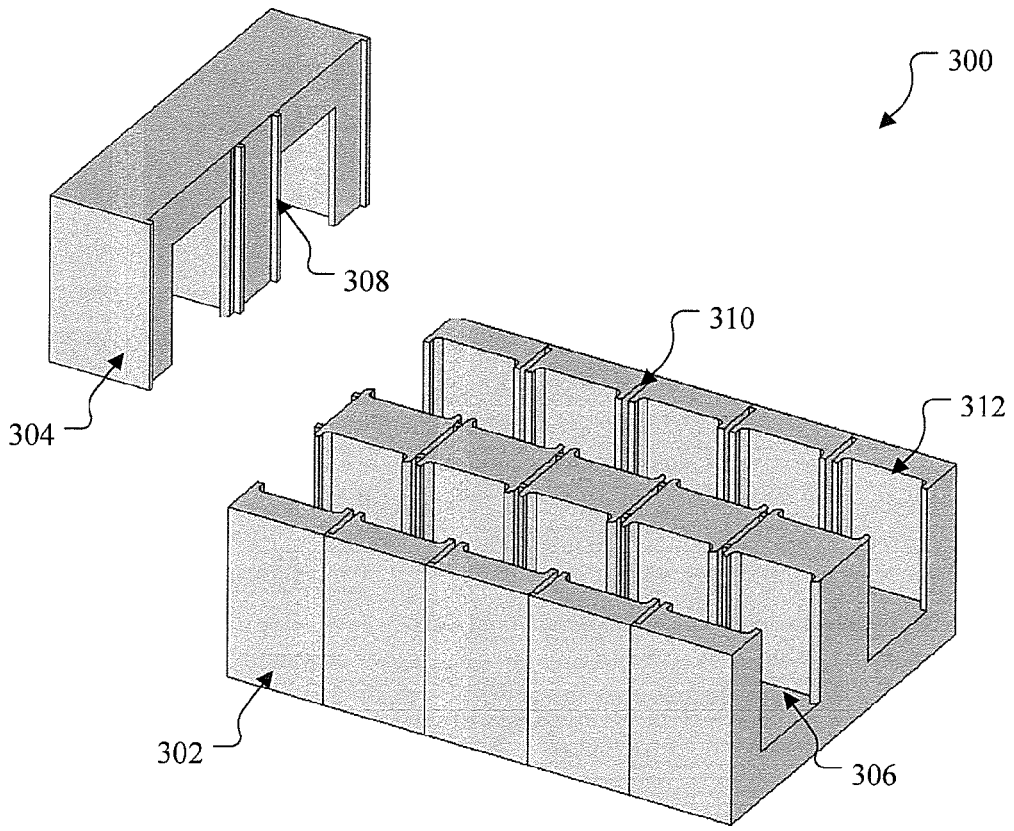
FIG. 3 illustrates an example core of a magnetic device in accordance with this disclosure.

FIG. 3 illustrates an example core 300 of a magnetic device in accordance with this disclosure. The core 300 could, for example, be used as the core 102 in the magnetic device 100 of FIG. 1. As shown in FIG. 3, the core 300 is divided into multiple lower segments 302 and multiple upper segments 304 (although only a single upper segment 304 is shown). The lower segments 302 can be bonded or otherwise connected together to form a lower core half, and the upper segments 304 can be bonded or otherwise connected together to form an upper core half. A coil assembly can be inserted into the core halves, and the core halves can be bonded or otherwise connected to form a magnetic device. The coil assembly fits within two openings 306 through the segments 302-304 of the core 300.

At least some of the segments 302-304 include protrusions 308, which can be used to maintain separation of adjacent segments 302-304 and form cooling channels 310. The protrusions 308 on the lower segments 302 can be bonded to adjacent segments 302 during formation of the lower core half, and the protrusions 308 on the upper segments 304 can be bonded to adjacent segments 304 during formation of the upper core half. The protrusions 308 could have any suitable size, shape, and dimensions. In particular embodiments, the protrusions 308 could have a width of 0.05 inches (1.27 mm) and a height of 0.05 inches (1.27 mm).

As shown in FIG. 3, the left and right sides of each opening 306 include broad grooves 312. The grooves 312 allow for the passage of coolant around the coil assembly that is inserted into the openings 306 of the segments 302-304. The grooves 312 could have any suitable size and shape, such as grooves that are 0.1 inches (2.54 mm) deep.

Although FIG. 3 illustrates one example of a core 300 of a magnetic device, various changes may be made to FIG. 3. For example, any number of lower and upper segments 302-304 could be used in the core 300. Also, while FIG. 3 illustrates that the lower and upper segments 302-304 are generally equal in size, this is not required, and other designs with unequal or different segments could be used. For instance, the lower segments 302 could span almost the entire height of the core 300, and one or more upper segments 302 could simply form a lid over the openings 306.

Figure 4A:
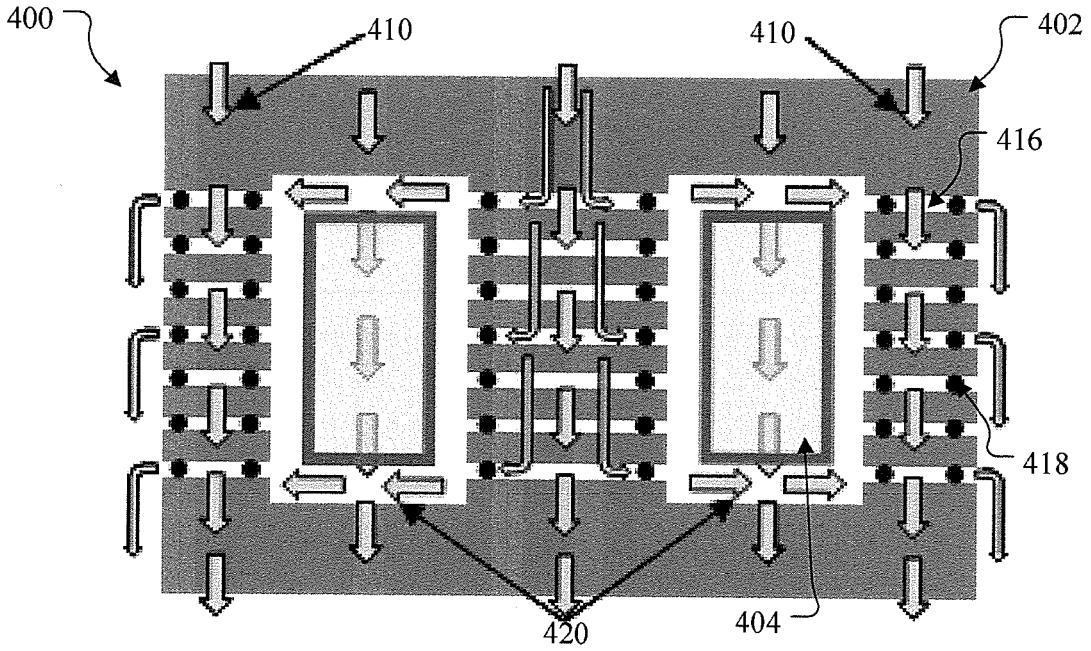
FIGS. 4A and 4B illustrate example coolant flows in a second magnetic device in accordance with this disclosure.
Figure 4B:
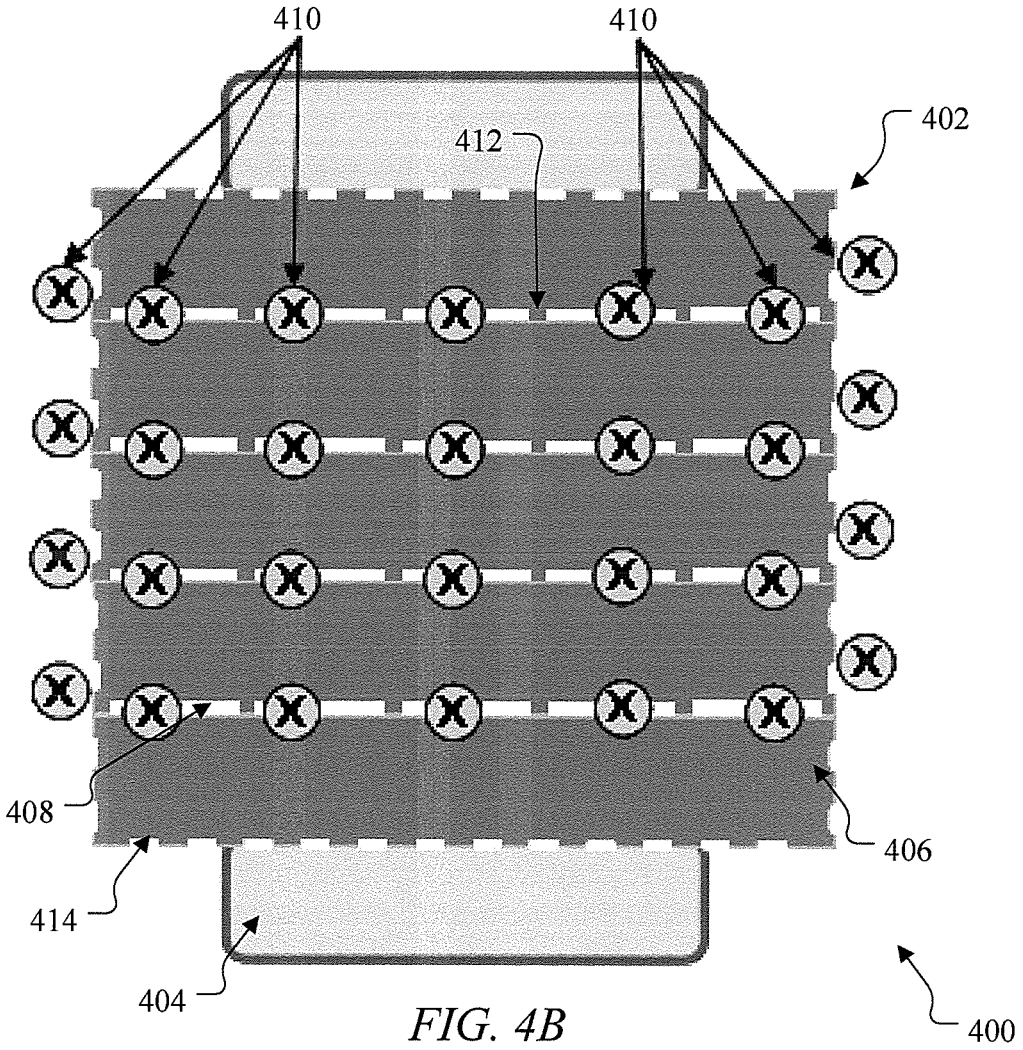

FIGS. 4A and 4B illustrate example coolant flows in a second magnetic device 400 in accordance with this disclosure. In particular, FIG. 4A shows coolant flows through the magnetic device 400 when the device 400 is viewed from the side, and FIG. 4B shows coolant flows through the magnetic device 400 when the device 400 is viewed from the top or bottom.

The magnetic device 400 represents an inductor having a core 402 and a coil assembly 404 with a coil that can transport a varying current. The core 402 is divided into slices or sections 406, and the sectioning of the core 402 could be done in a direction that is parallel to or coplanar with the direction of magnetic flux formed in the device 400. Cooling channels 408 exist between the sections 406 of the core 402. As with the transformer of FIG. 1, these cooling channels 408 allow for coolant flows 410 to pass through the core 402, thereby helping to remove heat from the core 402. The cooling channels 408 can be formed using protrusions 412 that project from the sides of at least some of the sections 406. One or more surfaces of the core 402 could also include grooves 414.

Various types of inductors may use gapped cores to avoid saturation. For example, AC inductors used in resonant converters often need a particularly large gap in order to reduce flux density and associated core losses. However, a single large gap can produce "fringing flux" that penetrates adjacent windings and generates additional losses. To reduce these losses, the device 400 uses multiple smaller gaps 416 distributed along the length of the magnetic path. Conventionally, spacers formed from a solid material like ceramic covering the whole cross-section of the core are introduced into the gaps. In the device 400, multiple smaller spacers 418 covering only a fraction of the cross-sectional area are used. The spacers 418 can be formed from any suitable material(s) and in any suitable manner. The presence of the gaps 416 and the use of smaller spacers 418 partially filling the gaps 416 create additional coolant flows 420 through the inductor, further cooling the device 400. The coolant flows 420 here are generally orthogonal to the direction of the magnetic flux in the device 400, so these flows 420 can be generally perpendicular to the coolant flows 410.

Note that the core 402 shown in FIGS. 4A and 4B could have the same overall structure as shown in FIG. 3, except that each of the segments 302-304 would include the horizontal gaps 416 and the spacers 418. In some embodiments, the segments 302-304 could be formed by making horizontal gaps 416 in a larger structure and then cutting the larger structure into vertical slices (of course other orientations of the components could be used). The lower segments 302 could then be assembled to form the lower core half, the upper segments 304 could be assembled to form the upper core half, the coil assembly 404 can be inserted, and the segments 302-304 could be connected together. This procedure may result in some offset between the gaps 416 in adjacent segments, and an allowance can be made to compensate for the core area lost due to the slicing of the core into segments. Note that if an inductor with tight tolerance is needed, its inductance may be adjusted by trimming one or more of the gaps 416. Although not shown, the coil assembly 404 of the magnetic device 400 can also include one or more cooling channels to help further cool the device 400, even in the presence of insulation.

Although FIGS. 4A and 4B illustrate examples of coolant flows in a second magnetic device 400, various changes may be made to FIG. 4. For example, the core 402 could include any suitable number of sections 406. Also, the coil assembly 404 could have any suitable number of turns. Further, any suitable number of protrusions 412 and cooling channels 408 could be used, and any suitable surface(s) could include grooves 414.

FIGS. 5A through 9B illustrate example cooling channels for a coil assembly of a magnetic device in accordance with this disclosure. As noted above, the coil assembly in a magnetic device may include cooling channels to help provide coolant across the winding(s) of the coil assembly. This can help to further cool the magnetic device.

Figure 5A:
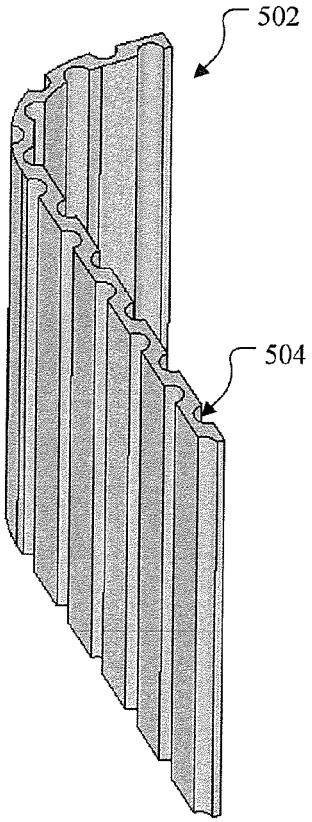
FIGS. 5A through 9B illustrate example cooling channels for a coil assembly of a magnetic device in accordance with this disclosure.
Figure 5B:
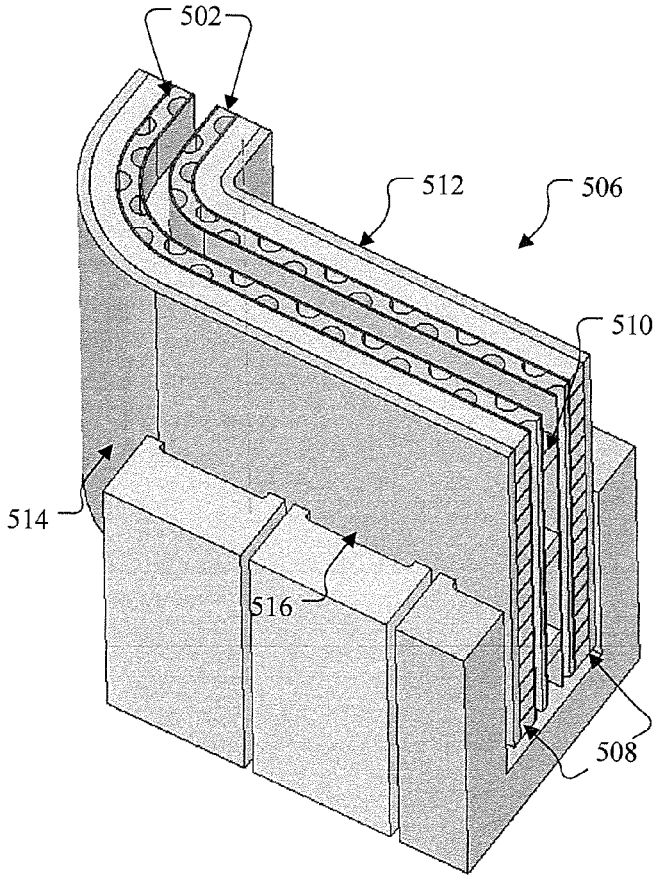

FIGS. 5A and 5B illustrate an example way to form cooling channels in a coil assembly. As shown in FIG. 5A, a spacer 502 includes multiple grooves 504. The grooves 504 extend over the entire height of the spacer 502 and are located on both sides of the spacer 502. The spacer 502 and the grooves 504 could have any suitable sizes, shapes, and dimensions. In particular embodiments, the spacer 502 has an overall thickness of 0.1 inches (2.54 mm), and each groove 504 extends 0.062 inches (1.575 mm) into the spacer 502. The spacer 502 could be formed from any suitable material(s), such as an insulative material like glass epoxy.

As shown in FIG. 5B, a coil assembly 506 includes two spacers 502 used to separate a first winding 508 and a second winding 510. The spacers 502 are said to represent inter-winding insulation since they are located between and separate different windings. Because each spacer 502 has grooves 504 on both sides of that spacer, coolant is able to flow through the spacers 502 and remove heat from both windings 508-510. Two additional spacers 512-514 can be used on the outer sides of the coil assembly 506. These spacers 512-514 are said to represent core-to-winding insulation since they are located between and separate windings from the core. Grooves 516 formed in the core allow coolant to flow between the core and the spacers 512-514, further removing heat from the coil assembly 506.

Figure 6:
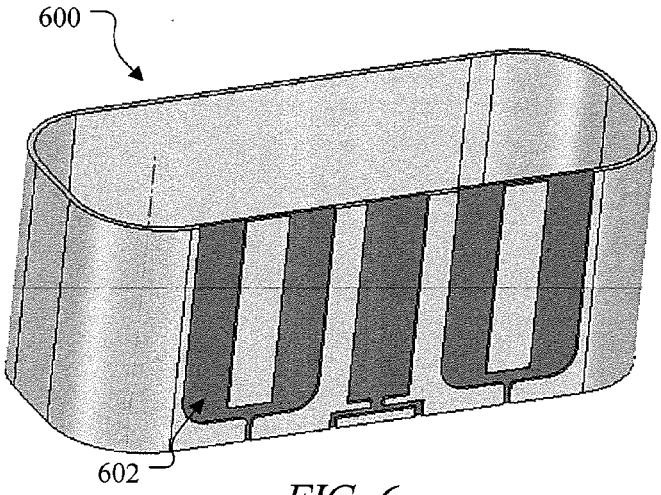

FIG. 6 illustrates a different example spacer 600 for a coil assembly. The spacer 600 here could be formed from one or more insulative materials like glass epoxy. Various channels 602 are formed in the sides of the spacer 600, such as by machining or molding. When one or more coils are wrapped around the spacer 600, the channels 602 provide paths for coolant to flow around the coils.

Figure 7A:
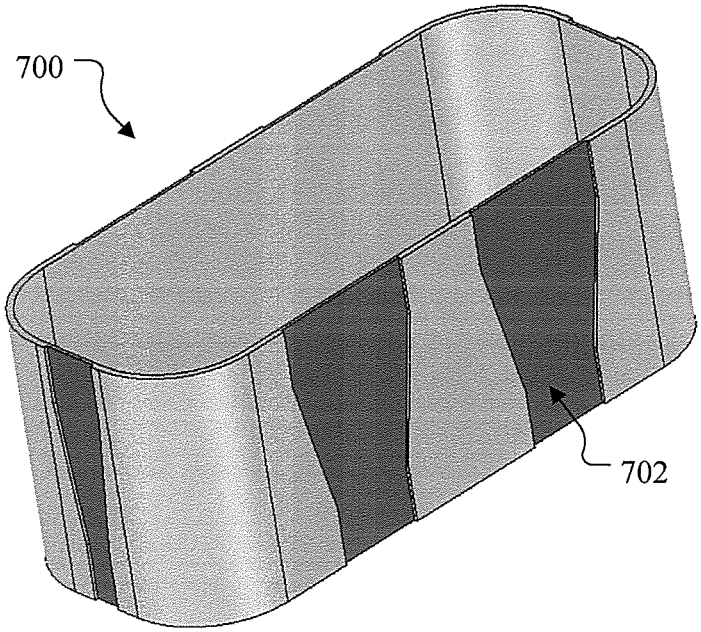
Figure 7B:
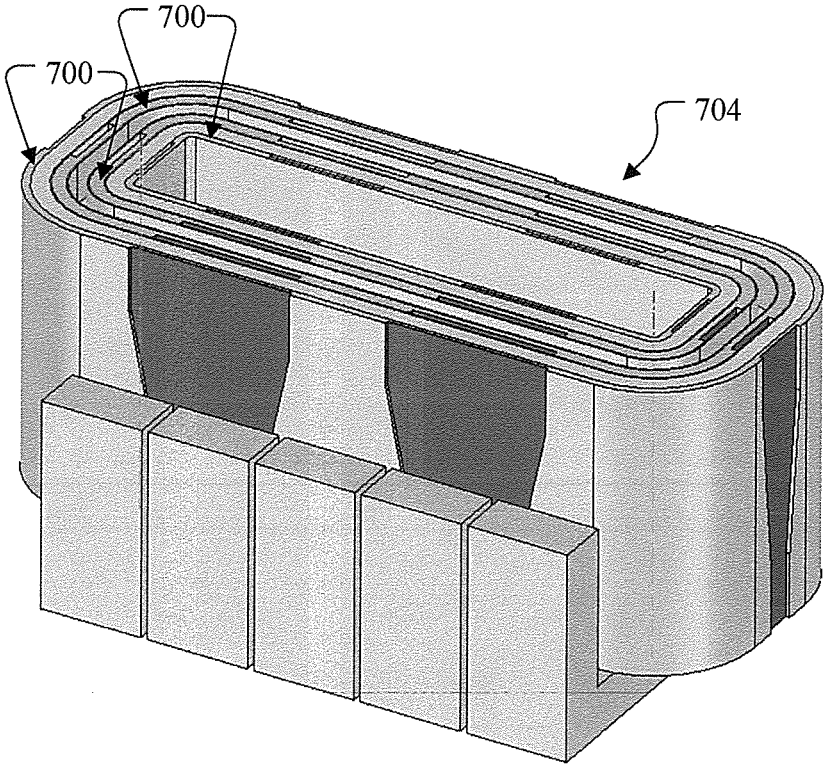
Figure 7C:
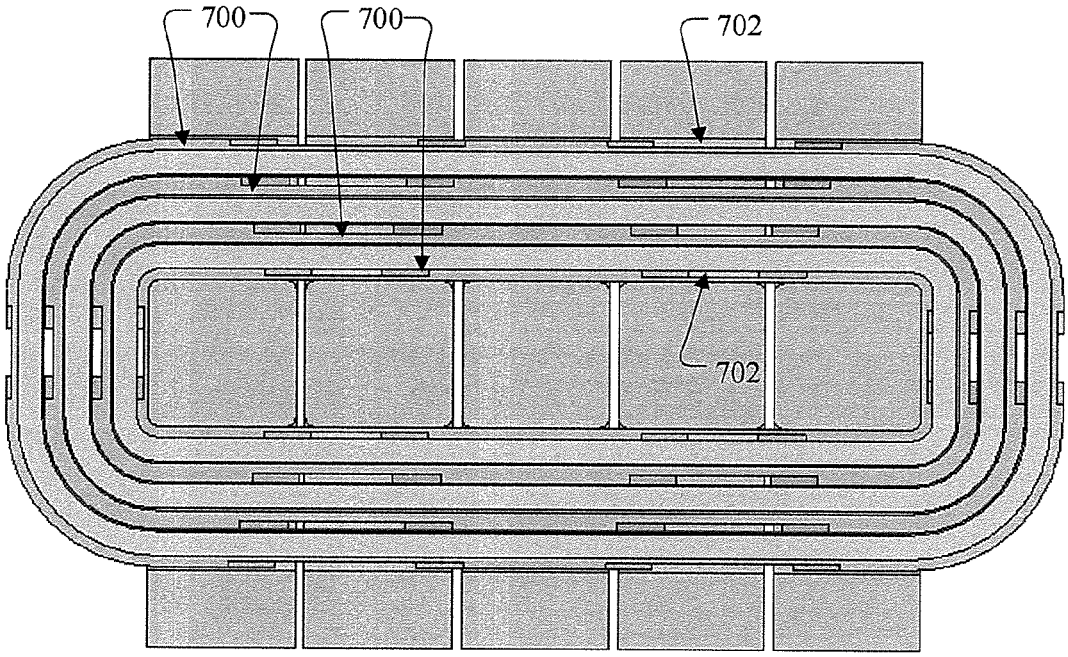

FIGS. 7A through 7C illustrate another example spacer 700 for a coil assembly. As shown in FIG. 7A, the spacer 700 could be formed from one or more insulative materials (such as glass epoxy), and various channels 702 are formed in the sides of the spacer 700 (such as by machining or molding). As shown in FIG. 7B, multiple spacers 700 (such as four spacers) could be used as core-to-winding insulation and inter-winding insulation in a coil assembly 704. As shown in FIG. 7C, at least some of the channels 702 in the spacers 700 could have variable sizes. In this example, the channels 702 on the longer sides of the spacers 700 vary, with the inner-most spacer 700 having the narrowest channels 702 and the outer-most spacer 700 having the widest channels 702.

Figure 8:
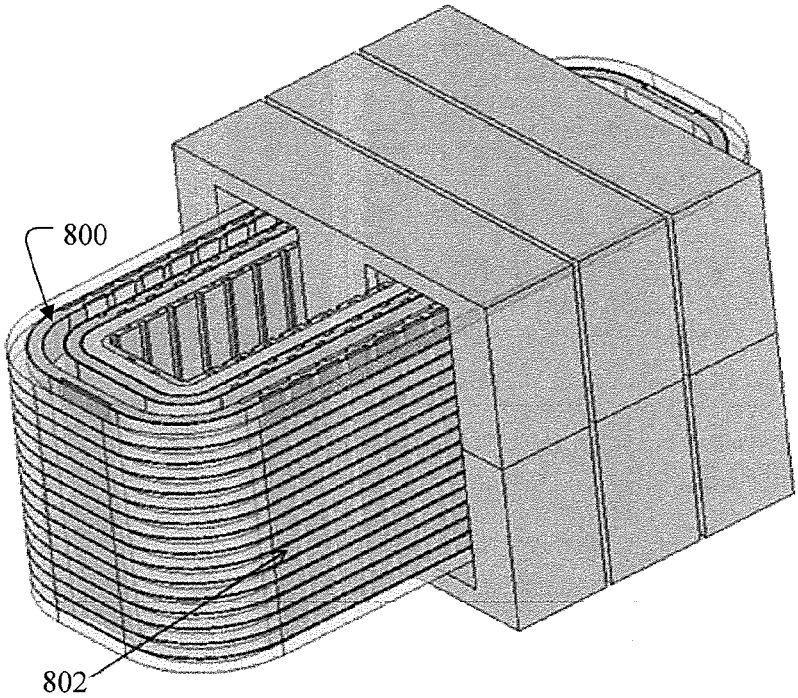

FIG. 8 illustrates yet another example spacer 800 for a coil assembly. The spacer 800 could be formed from one or more insulative materials (such as glass epoxy), and various channels 802 are formed in the sides of the spacer 800 (such as by machining or molding). Here, the channels 802 have generally straight sides top-to-bottom, resulting in substantially straight channels 802 along the height of the spacer 800.

Figure 9A:
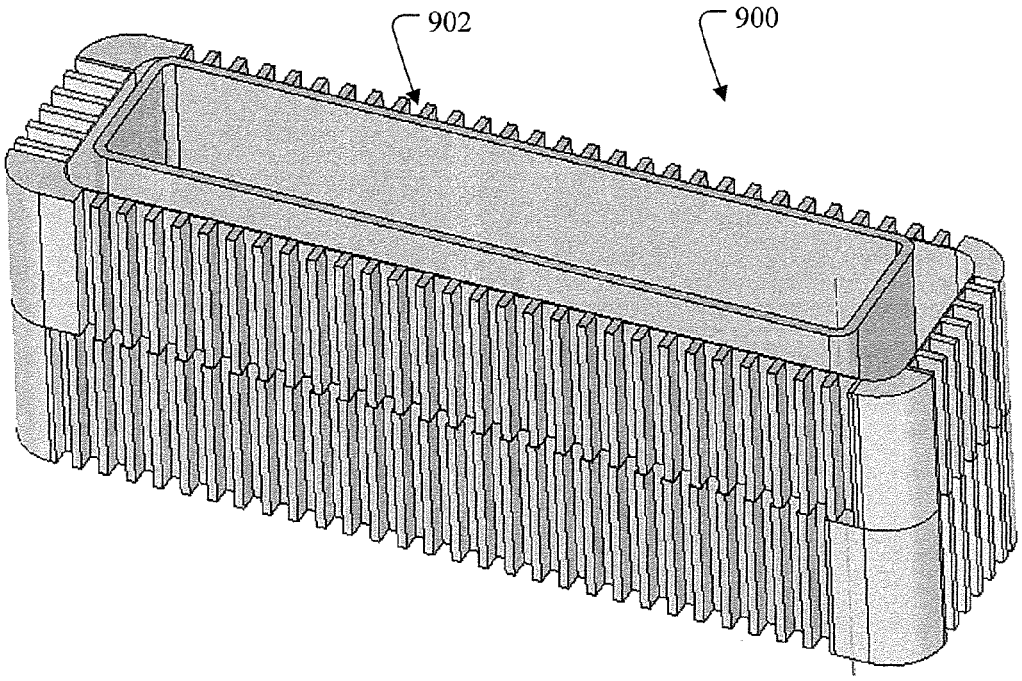
Figure 9B:
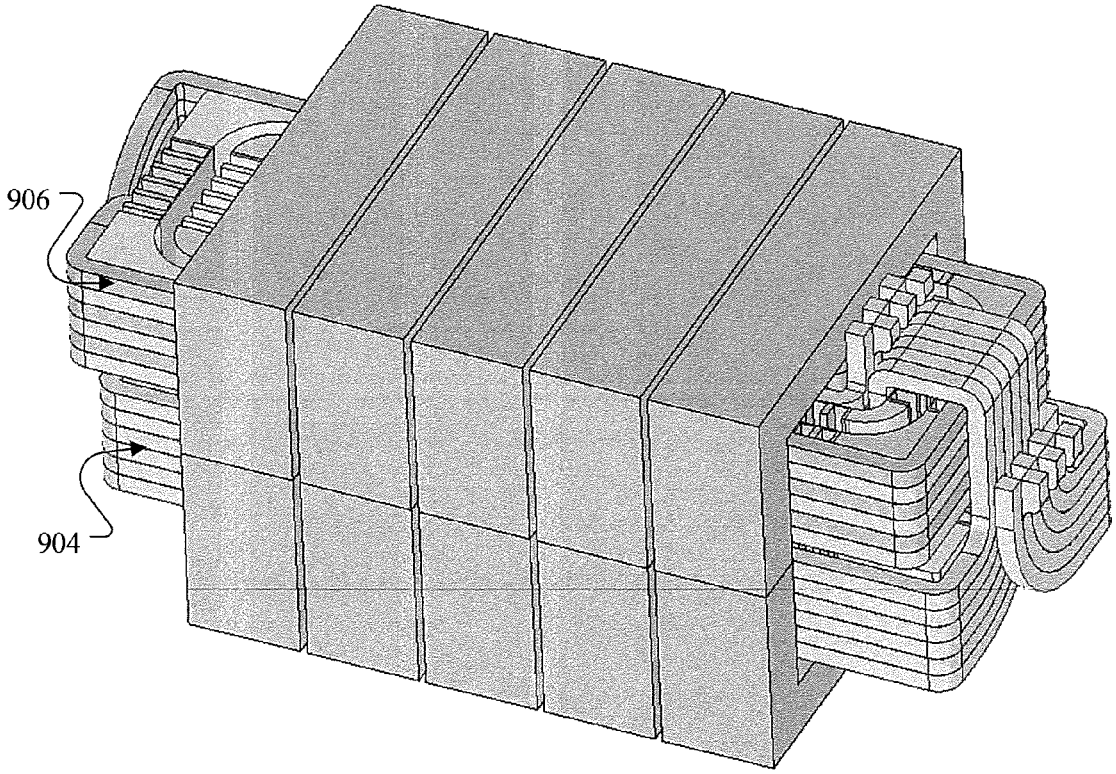

FIGS. 9A and 9B illustrate still another example spacer 900 for a coil assembly. In FIG. 9A, the spacer 900 could be formed from one or more insulative materials (such as glass epoxy), and various channels 902 are formed in the sides of the spacer 800 (such as by machining or molding). Here, the channels 902 are greater in number and deeper than in the other embodiments shown, for instance, in FIGS. 5A through 8. In FIG. 9B, multiple windings 904-906 have been wrapped around the spacer 900, and the channels 902 can be used to provide coolant paths for cooling those windings 904-906 during operation.

Although FIGS. 5A through 9B illustrate examples of cooling channels for a coil assembly of a magnetic device, various changes may be made to FIGS. 5A through 9B. For example, as can be seen in FIGS. 5A through 9B, a wide variety of cooling channels can be provided in the insulating spacers used in a coil assembly. Other cooling channels having other sizes, shapes, or dimensions could be used in a magnetic device. Also, a combination of these cooling channels could be used, such as when core-to-winding spacers have cooling channels of one form and inter-winding spacers have cooling channels of another form.

Figure 10:
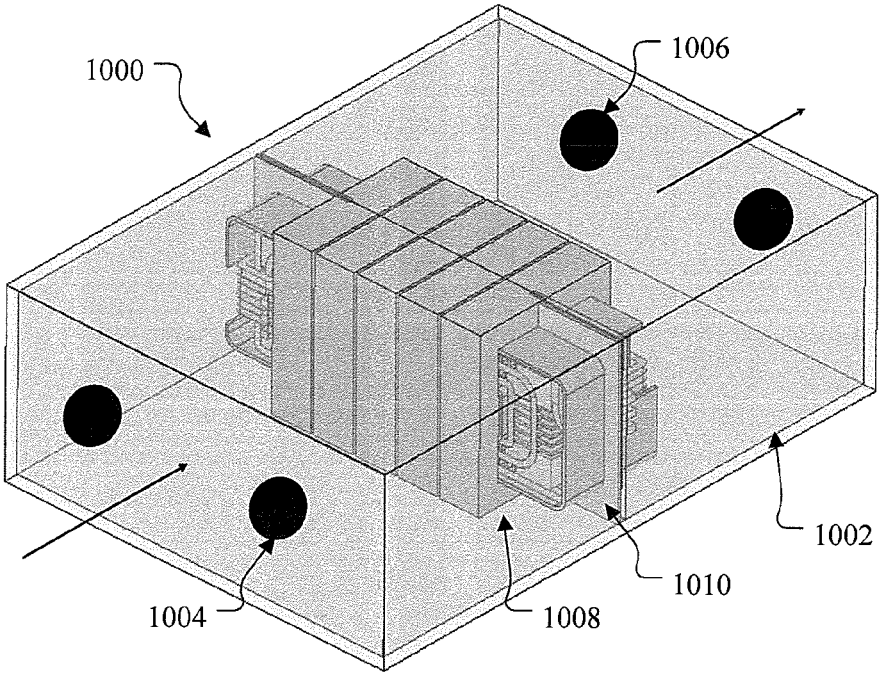
FIG. 10 illustrates an example assembly having a magnetic device with cooling channels in accordance with this disclosure.

FIG. 10 illustrates an example assembly 1000 having a magnetic device with cooling channels in accordance with this disclosure. As shown in FIG. 10, the assembly 1000 includes a housing 1002, which encases other components of the assembly 1000. The housing 1002 has one or more inlets 1004 through which coolant (such as air or fluid) enters the housing 1002 and one or more outlets 1006 through which the coolant exits the housing 1002. The housing 1002 includes any suitable structure configured to encase at least one component to be cooled. The inlets 1004 and outlets 1006 include any suitable structures configured to allow passage of coolant. In some embodiments where air is used as a coolant, the inlets 1004 and outlets 1006 could represent fan mountings.

A component 1008 within the housing 1002 represents a magnetic device to be cooled. The component 1008 in this example represents a transformer, although it could represent an inductor or other magnetic device. The component 1008 could include various cooling channels through a core and a coil assembly as described above.

A restrictor plate 1010 is bonded or otherwise connected to the housing 1002 and the component 1008 to be cooled. The restrictor plate 1010 forms a seal with the housing 1002 and the component 1008 so that coolant flowing from the inlets 1004 to the outlets 1006 is forced to flow through the cooling channels of the component 1008. The restrictor plate 1010 could be formed from any suitable material(s), such as plastic.

The assembly 1000 could form part of any suitable larger device or system. For example, the assembly 1000 could be used in air defense systems or other systems that use high-density high-voltage power supplies. The assembly 1000 could also be used in various types of high-voltage power converters, an electrical or solar grid or micro-grid, and various commercial applications, such as those that use high-density power converters.

Although FIG. 10 illustrates one example of an assembly 1000 having a magnetic device with cooling channels, various changes may be made to FIG. 10. For example, the assembly 1000 could include any number of components to be cooled.

Figure 11A:
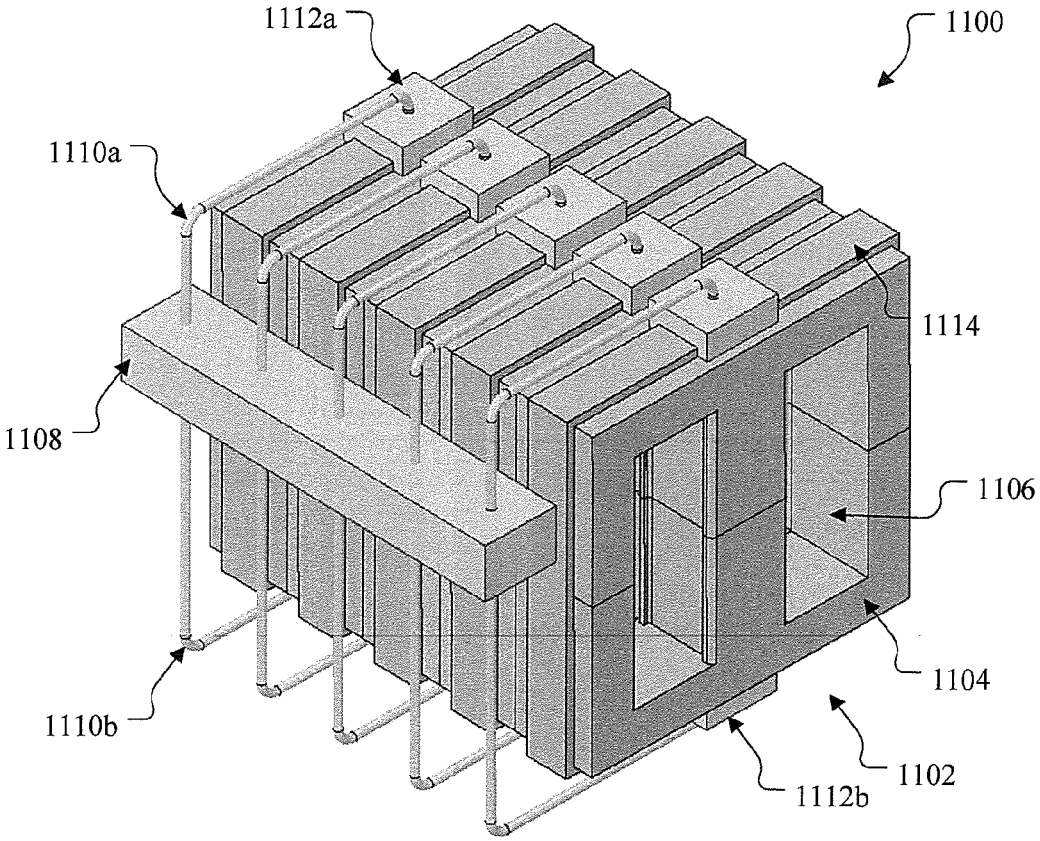
FIGS. 11A through 11C illustrate another example assembly having a magnetic device with cooling channels in accordance with this disclosure.
Figure 11B:
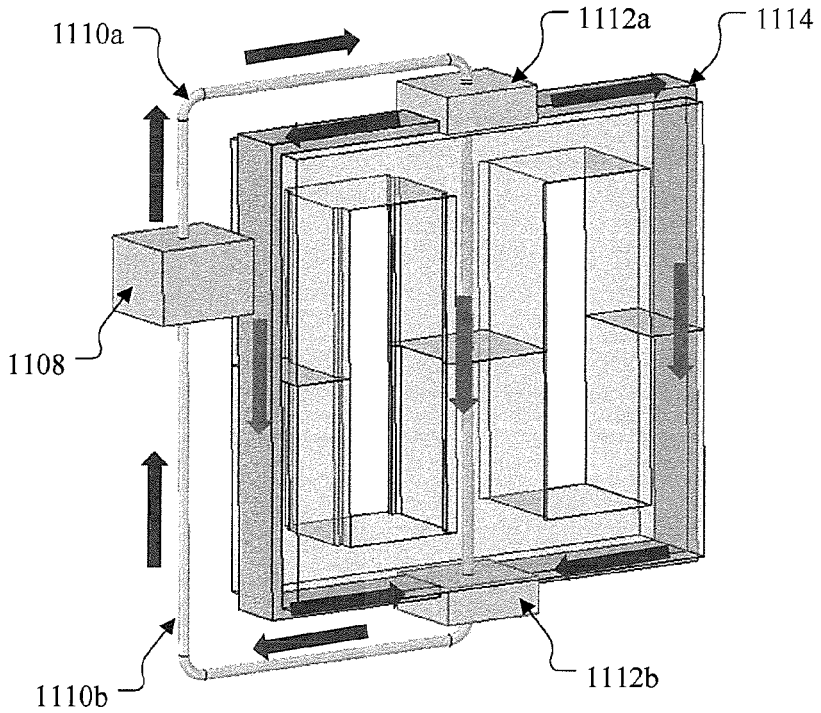
Figure 11C:
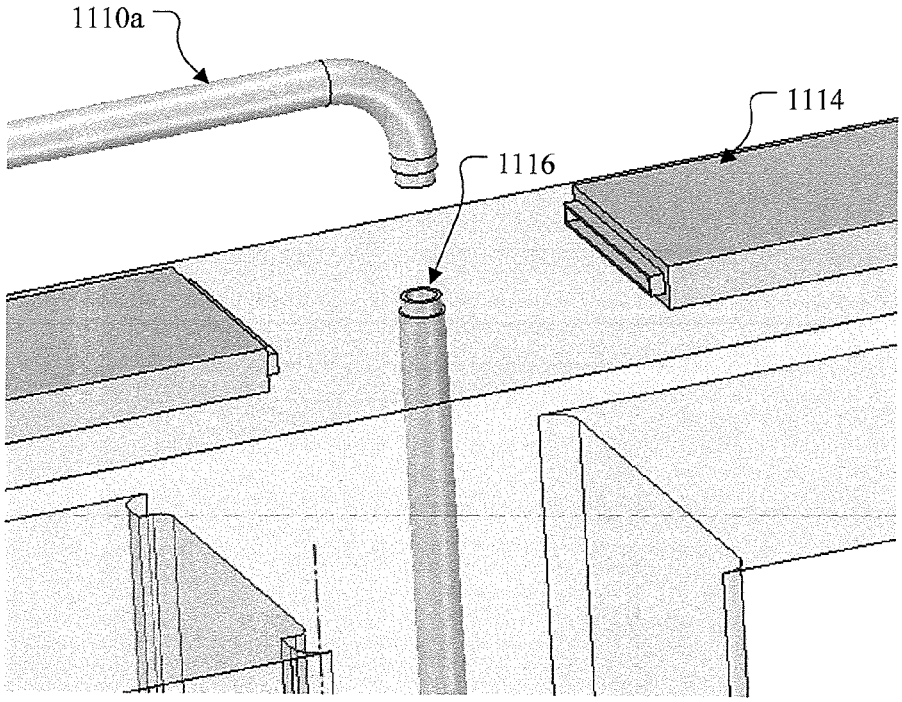

FIGS. 11A through 11C illustrate another example assembly 1100 having a magnetic device with cooling channels in accordance with this disclosure. As shown in FIG. 11A through 11C, the assembly 1100 includes a magnetic device having a segmented core 1102. The segmented core 1102 includes five segments 1104 in this example, although the core 1102 could include any number of segments 1104. The segments 1104 contain openings 1106 into which a coil assembly (such as those with or without its own cooling channels) could be inserted.

The assembly 1100 also includes multiple cooling loops, which supply coolant to the segments 1104 of the core 1102 in order to remove heat form the segments 1104. At least one pump 1108 operates to cause movement of coolant within the cooling loops. The pump 1108 includes any suitable structure for creating coolant movement. Note that a single pump 1108 could be used with multiple cooling loops, or each cooling loop could have its own pump 1108. Also note that the size of the pump 1108 could vary depending on, for example, the specific application in which the assembly 1100 is used.

Each cooling loop includes supply and return tubes 1110*a*-1110*b* and supply and return manifolds 1112*a*-1112*b*. The supply tubes 1110*a* provide coolant from the pump 1108 to the supply manifolds 1112*a*. Each supply manifold 1112*a* delivers coolant to side cooling channels 1114 and a central cooling channel 1116 associated with one of the core segments 1104. The side cooling channels 1114 transport coolant along the outer surfaces of the segments 1104, while the central cooling channels 1116 transport coolant through the segments 1104. The supply manifold 1112*a* is removed in FIG. 11C for clarity. The coolant flows through the channels 1114-1116 from each segment 1104 of the core 1102 to remove heat from that segment 1104. Each return manifold 1112*b* receives the coolant from the channels 1114-1116 in one of the segments 1104 and provides the coolant to the pump 1108 through the return tubes 1110*b*. In this way, the assembly 1100 forms a cooling system that circulates coolant within and around the segments 1104 of the core 1102 of a magnetic device. Note that while the core 1102 here resembles the core used in a transformer, the core 1102 could also represent the core of an inductor or other magnetic device having additional coolant flows (such as horizontal and vertical flows).

In particular embodiments, the assembly 1100 could be used in medium-power applications, such as those that do not require use of a dedicated enclosure for magnetic components. Also, in particular embodiments, the tubes 1110*a*-1110*b* could be formed from non-metallic material(s), and the cooling channels 1114 could be formed using thermally conductive material(s). In addition, the cooling channels' size(s) and configuration(s) can be designed to meet thermal and packaging requirements for specific applications.

Although FIGS. 11A through 11C illustrate another example of an assembly 1100 having a magnetic device with cooling channels, various changes may be made to FIGS. 11A through 11C. For example, while the cooling channel 1116 is shown as forming a circular path through the segment 1104 of the core 1102, the cooling channel 1116 could have any other suitable cross-sectional shape. Also, multiple cooling channels 1116 could be formed through each segment 1104.

Figure 12:
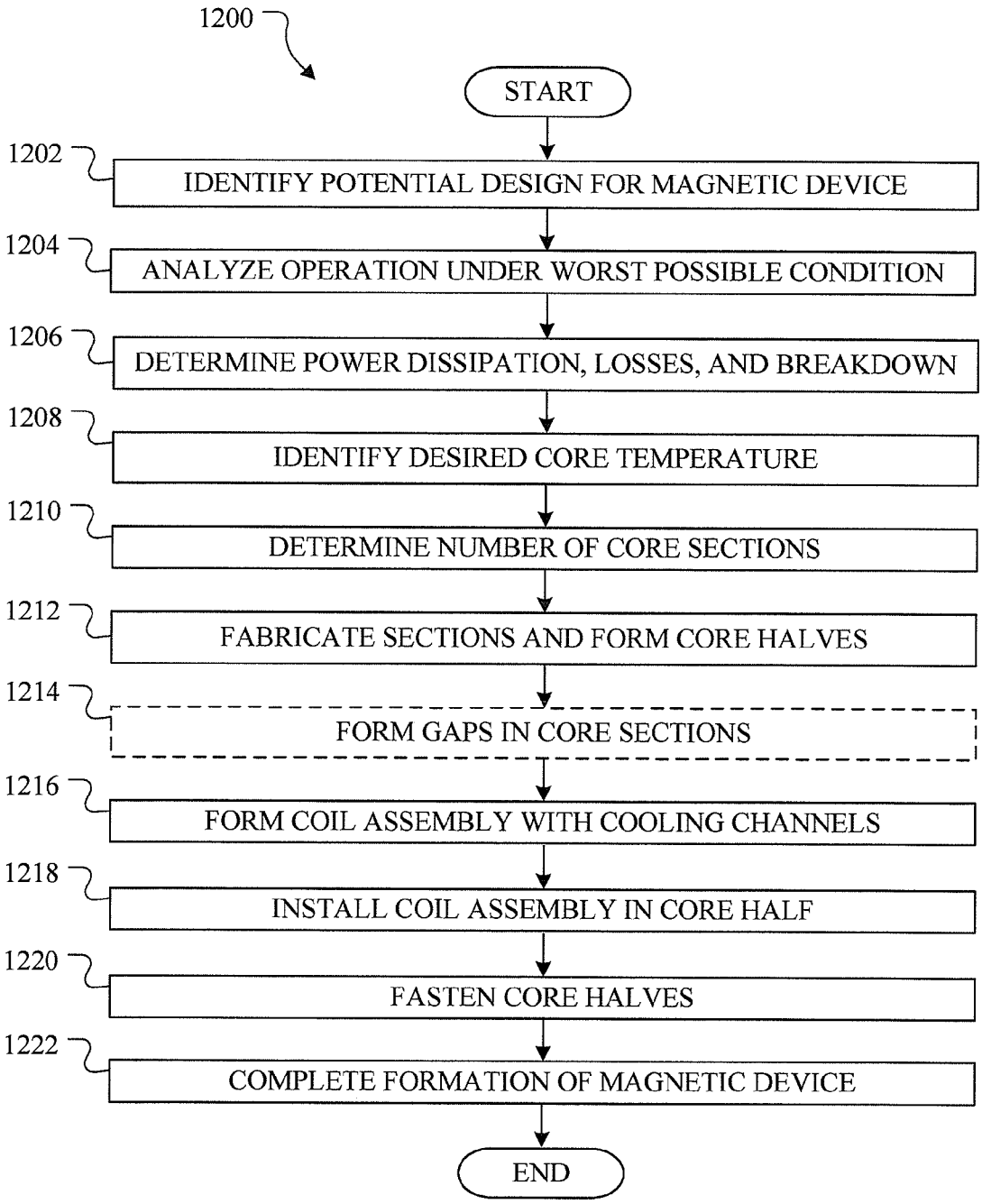
FIG. 12 illustrates an example method for forming a magnetic device having cooling channels in accordance with this disclosure.

FIG. 12 illustrates an example method 1200 for forming a magnetic device having cooling channels in accordance with this disclosure. As shown in FIG. 12, a potential design for a magnetic device is identified at step 1202. This could include, for example, identifying the design and operational characteristics of a transformer or inductor. The design of the magnetic device is analyzed to identify its expected operation under its worst possible operating conditions at step 1204. This could include, for example, simulating the behavior of the designed transformer or inductor during a prolonged period of continuous operation. The total power dissipation, losses, and breakdown between the core and the device's winding(s) are identified at step 1206 based on the simulated operation.

The desired temperature of the core in the magnetic device is identified at step 1208. This could include, for example, identifying the desired temperature of the core to maintain stable, long-term operation based on the simulations. The number of sections for the core is identified at step 1210. This could include, for example, determining whether the core can be maintained at or below the desired temperature using a single-piece solid core. If not, a number of core sections (with associated cooling channels) needed to maintain the core at or below the desired temperature can be identified. The identification of the number of core segments could be determined in any suitable manner, such as analytically or using final element modeling.

The individual core sections are fabricated and used to form core halves at step 1212. This could include, for example, fabricating upper and lower core segments, where at least some of the core segments have protrusions or integrated cooling channels. This could be done, for instance, by machining custom ferrite or other cores or by molding. Lower segments can be bonded or otherwise connected together to form a lower core half, and upper segments can be bonded or otherwise connected together to form an upper core half. Each core half can include one or multiple cooling channels created using the protrusions or the integrated cooling channels. Optionally, gaps are formed at step 1214. This could include, for example, making horizontal cuts through the core segments or through a larger block of material used to form the core segments and inserting horizontal spacers into the cuts. When an inductor is being formed, the number and size(s) of the gaps can be selected based on the desired inductance value of the inductor. Note that the formation of the gaps could occur at any time during fabrication of the core segments, fabrication of the core halves, or fabrication of the whole core.

A coil assembly is formed at step 1216. This could include, for example, forming a coil assembly having one or more coils with any suitable number of turns. This could also include using one or more insulative spacers during formation of the coil assembly. At least one of the insulative spacers could include cooling channels that allow coolant to flow through the insulative spacers and remove heat from the coil(s).

The coil assembly is installed in one core half at step 1218, and the core halves are connected at step 1220. This could include, for example, placing the coil assembly into openings of the lower core half and connecting the upper core half to the lower core half (although the upper and lower halves could be reversed here). The halves can be connected in any suitable manner. The formation of the magnetic device is completed at step 1222. This could include, for example, forming external electrostatic and magnetic shields or other components as needed.

Although FIG. 12 illustrates one example of a method 1200 for forming a magnetic device having cooling channels, various changes may be made to FIG. 12. For example, while shown as a series of steps, various steps in FIG. 12 could overlap, occur in parallel, occur in a different order, or occur multiple times.

In the description above, reference has been made to using air or fluid to support cooling of a magnetic device. However, the approaches described here could be used with a single magnetic device and with assemblies containing multiple magnetic devices. Also, various methods could be used to cool the magnetic device(s), including convection, convection and conduction, forced air, and forced liquid. Any suitable coolants can be used, such as water, a water and ethylene glycol mixture, oil, atmospheric gas, or cryogenic gas. Control of the cooling medium may or may not be needed and can depend, among other things, on the power to be dissipated. In addition, while the use of both cooling channels in the core and cooling channels in the coil assembly of a magnetic device has been described, a magnetic device could include cooling channels in the core or cooling channels in the coil assembly.

It may be advantageous to set forth definitions of certain words and phrases used throughout this patent document. The terms "include" and "comprise," as well as derivatives thereof, mean inclusion without limitation. The term "or" is inclusive, meaning and/or. The phrase "associated with," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, have a relationship to or with, or the like. The phrase "at least one of," when used with a list of items, means that different combinations of one or more of the listed items may be used, and only one item in the list may be needed. For example, "at least one of: A, B, and C" includes any of the following combinations: A, B, C, A and B, A and C, B and C, and A and B and C.

While this disclosure has described certain embodiments and generally associated methods, alterations and permutations of these embodiments and methods will be apparent to those skilled in the art. Accordingly, the above description of example embodiments does not define or constrain this disclosure. Other changes, substitutions, and alterations are also possible without departing from the spirit and scope of this disclosure, as defined by the following claims.

What is claimed is:

1. An apparatus comprising:

a coil assembly comprising at least one winding configured to receive a varying electrical current;

a core comprising multiple segments, the at least one winding wound around portions of the segments and configured to generate a magnetic flux; and a plurality of cooling channels configured to transport coolant through the coil assembly or core in order to cool the coil assembly or core, wherein the plurality of cooling channels comprises (i) a plurality of first cooling channels that extend in a first direction through the core and (ii) a plurality of second cooling channels formed in gaps between the multiple segments and that extend in a second direction through the core;

wherein at least some segments of the core comprise protrusions that contact adjacent segments of the core to maintain separation from the adjacent segments and form the second cooling channels; and wherein the at least one winding extends through the core in a third direction substantially orthogonal to the first and second directions.

2. The apparatus of claim 1, wherein the second cooling channels are configured to transport coolant through the core.

3. The apparatus of claim 1, wherein:

the segments comprise a plurality of upper segments and a plurality of lower segments; and the gaps between the segments comprise a plurality of upper gaps between the upper segments and a plurality of lower gaps between the lower segments.

4. The apparatus of claim 1, wherein:

at least one surface of the core comprises grooves; and the grooves are aligned with a direction of coolant flow through the core.

5. The apparatus of claim 1, wherein:

the coil assembly further comprises at least one insulative spacer;

the at least one insulative spacer comprises a plurality of third cooling channels; and the plurality of third cooling channels are configured to transport coolant through the coil assembly.

6. The apparatus of claim 5, wherein the at least one insulative spacer comprises at least one of:

one or more spacers forming core-to-winding insulation; and one or more spacers forming inter-winding insulation.

7. A system comprising:

a housing comprising at least one inlet configured to receive coolant and at least one outlet configured to provide the coolant; and an electronic device to be cooled within the housing, the electronic device comprising a magnetic device that includes:

a coil assembly comprising at least one winding configured to receive a varying electrical current;

a core comprising multiple segments, the at least one winding wound around portions of the segments and configured to generate a magnetic flux; and a plurality of cooling channels configured to transport the coolant through the coil assembly or core in order to cool the coil assembly or core, wherein the plurality of cooling channels comprises (i) a plurality of first cooling channels that extend in a first direction through the core and (ii) a plurality of second cooling channels formed in gaps between the multiple segments and that extend in a second direction through the core;

wherein at least some segments of the core comprise protrusions that contact adjacent segments of the core to maintain separation from the adjacent segments and form the second cooling channels; and wherein the at least one winding extends through the core in a third direction substantially orthogonal to the first and second directions.

8. The system of claim 7, further comprising:

a restrictor plate connected to the housing and the electronic device, the restrictor plate configured to force the coolant from the at least one inlet through the electronic device to the at least one outlet.

9. The system of claim 7, wherein the second cooling channels are configured to transport the coolant through the core.

10. The system of claim 7, wherein:

the segments comprise a plurality of upper segments and a plurality of lower segments; and the gaps between the segments comprise a plurality of upper gaps between the upper segments and a plurality of lower gaps between the lower segments.

11. The system of claim 7, wherein:

the first cooling channels are disposed through at least some of the segments and the second cooling channels are disposed along outer surfaces of at least some of the segments; and the system further comprises multiple cooling loops configured to circulate the coolant through the first and second cooling channels.

12. The system of claim 7, wherein:

at least one surface of the core comprises grooves; and the grooves are aligned with a direction of coolant flow through the core.

13. The system of claim 7, wherein:

the coil assembly further comprises at least one insulative spacer;

the at least one insulative spacer comprises a plurality of third cooling channels; and the plurality of third cooling channels are configured to transport the coolant through the coil assembly.

14. The system of claim 13, wherein the at least one insulative spacer comprises at least one of:

one or more spacers forming core-to-winding insulation; and one or more spacers forming inter-winding insulation.

15. The apparatus of claim 2, further comprising a plurality of spacers, each spacer partially filling each of the first cooling channels, the first cooling channels disposed through at least some of the segments, and wherein the second direction is at least one of: parallel to and coplanar with the direction of the magnetic flux.

* * * * *